US009121220B2

(12) United States Patent
Zhang et al.

(10) Patent No.: US 9,121,220 B2
(45) Date of Patent: Sep. 1, 2015

(54) HOLLOW BUILT-IN BLIND

(71) Applicant: SHANGHAI KING HUA IG BLINDS CO., LTD., Liuhe, Taicang (TW)

(72) Inventors: Xuezhong Zhang, Songjiang (CN); Szu-Chang Huang, Changhua County (TW)

(73) Assignee: Shanghai Kingshine Plastic Manufacture Co., Ltd., Shanghai (CN)

( * ) Notice: Subject to any disclaimer, the term of this patent is extended or adjusted under 35 U.S.C. 154(b) by 0 days.

(21) Appl. No.: 14/082,001

(22) Filed: Nov. 15, 2013

(65) Prior Publication Data

US 2014/0209256 A1 Jul. 31, 2014

Related U.S. Application Data

(63) Continuation-in-part of application No. 13/321,512, filed as application No. PCT/CN2010/072676 on May 12, 2010, now Pat. No. 8,616,260.

(30) Foreign Application Priority Data

May 22, 2009 (CN) ..... 2009 2 0072816 U

(51) Int. Cl.
*E06B 9/264* (2006.01)

(52) U.S. Cl.
CPC ..... *E06B 9/264* (2013.01); *E06B 2009/2643* (2013.01); *E06B 2009/2646* (2013.01)

(58) Field of Classification Search
USPC ..... 160/107, 170, 171, 98
IPC ..... E06B 9/264,2009/2646, 2009/2643
See application file for complete search history.

(56) References Cited

U.S. PATENT DOCUMENTS

| | | | |
|---|---|---|---|
| 812,722 | A | 2/1906 | Cahill |
| 2,276,716 | A | 3/1942 | Cardona |
| 2,420,301 | A | 11/1944 | Cusumano |

(Continued)

FOREIGN PATENT DOCUMENTS

| | | | |
|---|---|---|---|
| CN | 200971738 | Y | 11/2007 |
| CN | 101230774 | A | 7/2008 |

(Continued)

OTHER PUBLICATIONS

International Preliminary Examination Report/Written Opinion for PCT/CN2010/072676 dated Nov. 22, 2011 and its English translation.

(Continued)

*Primary Examiner* — David Purol
(74) *Attorney, Agent, or Firm* — Ladas & Parry, LLP

(57) ABSTRACT

A hollow built-in blind includes two glass plates, an annular spacer cooperating with the glass plates to define a receiving space, and a blind disposed in the receiving space and including a lower rail, a plurality of slats, and two pull cords connected to the lower rail. A transmission unit includes a transmission shaft, a winding mechanism disposed on the shaft, and a belt pulley fixed to one end of the shaft. A drive unit is located at one lateral end of the blind and includes a guide wheel spaced apart from the belt pulley, an internal control device operable to move upward and downward in the receiving space, and a timing belt looped over the belt pulley and the guide wheel and having two opposite ends connected to the internal control device to form a closed loop.

5 Claims, 8 Drawing Sheets

(56) References Cited

U.S. PATENT DOCUMENTS

| | | | | |
|---|---|---|---|---|
| 2,758,644 | A | 8/1956 | Virlouvet | |
| 3,141,497 | A | 7/1964 | Griesser | |
| 3,352,349 | A | 11/1967 | Hennequin | |
| 5,113,922 | A | 5/1992 | Christensen | |
| 5,228,491 | A * | 7/1993 | Rude et al. | 160/171 |
| 5,282,504 | A | 2/1994 | Anderson | |
| 5,628,356 | A * | 5/1997 | Marocco | 160/170 |
| 6,116,323 | A | 9/2000 | Huang | |
| 6,601,633 | B2 | 8/2003 | Sun | |
| 6,622,769 | B2 | 9/2003 | Judkins | |
| 6,655,441 | B2 | 12/2003 | Wen | |
| 6,817,401 | B2 * | 11/2004 | Sun et al. | 160/107 |
| 7,082,982 | B2 | 8/2006 | Eveland | |
| 7,124,803 | B2 | 10/2006 | Jin | |
| 7,137,430 | B2 * | 11/2006 | Fraczek | 160/170 |
| 7,234,501 | B1 | 6/2007 | Park | |
| 7,287,569 | B2 | 10/2007 | Lin | |
| 7,654,300 | B2 | 2/2010 | Chigusa | |
| 2004/0211528 | A1 | 10/2004 | Jin | |
| 2004/0238131 | A1 * | 12/2004 | Eveland et al. | 160/107 |
| 2006/0118250 | A1 * | 6/2006 | Jin et al. | 160/107 |
| 2006/0249264 | A1 * | 11/2006 | Lin | 160/171 |
| 2008/0029226 | A1 * | 2/2008 | Huang | 160/107 |
| 2008/0283200 | A1 * | 11/2008 | Hummel et al. | 160/107 |

FOREIGN PATENT DOCUMENTS

| | | | |
|---|---|---|---|
| CN | 201202361 | Y | 3/2009 |
| GB | 2432179 | A | 5/2007 |
| JP | 2003-278464 | | 10/2003 |

OTHER PUBLICATIONS

International Search Report for PCT/CN2010/072676 mailed on Aug. 26, 2010 and its English translation.

Office action dated Jan. 24, 2013 from U.S. Appl. No. 13/321,572.

* cited by examiner

HOLLOW BUILT-IN BLIND

CROSS-REFERENCE TO RELATED APPLICATION

This application is a continuation-in-part of U.S. patent application Ser. No. 13/321,512, filed on Nov. 18, 2011, which is a U.S. National Stage Application of International Patent Application No. PCT/CN2010/072676, filed on May 12, 2010, the disclosures of which are hereby incorporated by reference in their entireties. To the extent appropriate, a claim of priority is made to each of the applications disclosed above.

BACKGROUND OF THE INVENTION

1. Field of the Invention

This invention relates to a blind, more particularly to a hollow built-in blind.

2. Description of the Related Art

Referring to FIGS. 1 to 3, a conventional hollow built-in blind 1 includes two glass plates 11, an annular spacer 12, a blind 13, an upper rail 14, a side frame 15 and a winding mechanism 16.

The annular spacer 12 is disposed between the glass plates 11, so that the glass plates 11 are spacedly parallel to each other. The spacer 12 and the glass plates 11 cooperatively define a receiving space 10.

The blind 13 is disposed in the receiving space 10, and includes a lower rail 131, a plurality of slats 132, two pull cords 133 each having one end connected to the lower rail 131 and the other end extending through the slats 132, and two cord ladders 134 corresponding to the pull cords 133 and used for turning the slats 132.

The upper rail 14 is disposed in the receiving space 10 above the blind 13, and has a U-shaped groove 141, and a PVC cover plate 142 covering the U-shaped groove 141.

The side frame 15 is disposed in the receiving space 10 and is located at one lateral side of the blind 13. The side frame 15 has a U-shaped groove 151, and a PVC cover plate (not shown) covering the U-shaped groove 151.

The winding mechanism 16 includes a slat turning unit 161, a blind actuating unit 162 disposed in the U-shaped groove 151 of the side frame 15, and an external control device 163. The slat turning unit 161 includes a transmission shaft 164 disposed in the U-shaped groove 141 of the upper rail 14, and two cord ladder turning devices 165 spacedly disposed on the transmission shaft 164 and respectively connected to the cord ladders 134. The blind actuating unit 162 includes an upper pulley 166 disposed on one end of the transmission shaft 164, a lower pulley 167 disposed on one end of the side frame 15 that is distal from the transmission shaft 164, an internal control device 168, a transmission belt 160 looped over the upper and lower pulleys 166, 167 and having two opposite ends respectively connected to the internal control device 168, and a spring 169 connected to the transmission belt 160 and the internal control device 168. The internal control device 168 is operable to move upward and downward in the U-shaped groove 151 of the side frame 15. The external control device 163 includes a guide rail 1631 fixed to an outer surface of the glass plate 11 that is adjacent to the PVC cover plates 142 and extending in a moving direction of the internal control device 168, an external controller 1632 disposed slidably on the guide rail 1631 and corresponding to the internal control device 168, and two magnets 1633 respectively disposed in the internal control device 168 and the external controller 1632. The external controller 1632 drives the internal control device 168 through magnetic attraction between the magnets 1633.

The other end of each pull cord 133 of the blind 13 is connected to the internal control device 168 after extending through the slats 132. Through the downward and upward movement of the internal control device 168 within the U-shaped groove 151 of the side frame 15, the pull cords 133 are pulled and released to raise and lower the lower rail 131 and the slats 132, respectively. When the slats 132 are lowered, the transmission shaft 164 is actuated by the upper pulley 166 to drive the cord ladder turning devices 165 to pull the cord ladders 134 and turn the slats 132 to an open or a closed position. During turning of the slats 132, the transmission shaft 164 cannot be activated by the upper pulley 166.

The pull cords 133 of the blind 13 pass along several turning points before connecting with the internal control device 168. This not only will cause the pull cords 133 to rub against the turning points and wear out and break, but also will cause the internal control device 168 to pull the pull cords 133 with difficulty so that the transmission efficiency thereof is low. Further, portions of the pull cords 133 in the U-shaped groove 151 of the side frame 15 will interfere with the operation of the transmission belt 160 which is connected to the internal control device 168, the upper pulley 166 and the lower pulley 167, so that the transmission belt 160 may slip on the upper and lower pulleys 166, 167 and the transmission thereof is not smooth.

SUMMARY OF THE INVENTION

Therefore, the object of the present invention is to provide a hollow built-in blind having simple transmission components with high transmission accuracy and smoothness.

Accordingly, a hollow built-in blind of the present invention comprises two glass plates, an annular spacer disposed between and cooperating with the glass plates to define a receiving space, a blind disposed in the receiving space, a transmission unit disposed in the receiving space above the blind, and a drive unit disposed in the receiving space and located at one lateral end of the blind that is proximate to the belt pulley. The blind includes a lower rail, a plurality of slats, and two pull cords each having one end connected to the lower rail and the other end extending through the slats. The transmission unit includes a rotatable transmission shaft, a winding mechanism disposed on the transmission shaft, and a belt pulley fixed to one end of the transmission shaft. The other ends of the pull cords are connected to the winding mechanism after extending through the slats. The drive unit includes a guide wheel spaced apart from the belt pulley, an internal control device operable to move upward and downward in the receiving space, and a timing belt looped over the belt pulley and the guide wheel and having two opposite ends connected to the internal control device to form a closed loop. When the internal control device is operated to move downward, the timing belt is pulled by the internal control device to drive rotation of the belt pulley which, in turn, drives rotation of the transmission shaft so as to wind the pull cords on the winding mechanism to thereby raise the slats. When the internal control device is operated to move upward, the timing belt is pulled by the internal control device to drive reverse rotation of the belt pulley which, in turn, drives reverse rotation of the transmission shaft so as to unwind the pull cords from the winding mechanism to thereby lower the slats.

The efficiency of this invention resides in that because the timing belt is meshed with the belt pulley, the internal control device of the present invention can accurately actuate the belt pulley to drive the transmission shaft to rotate so as to wind and unwind the pull cords. Further, the transmission unit of this invention not only has simple components, but also has high transmission accuracy and smoothness. Moreover, the pull cords can be directly wound on and unwound from the respective cord-winding devices so as to smoothly raise and lower the slats.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
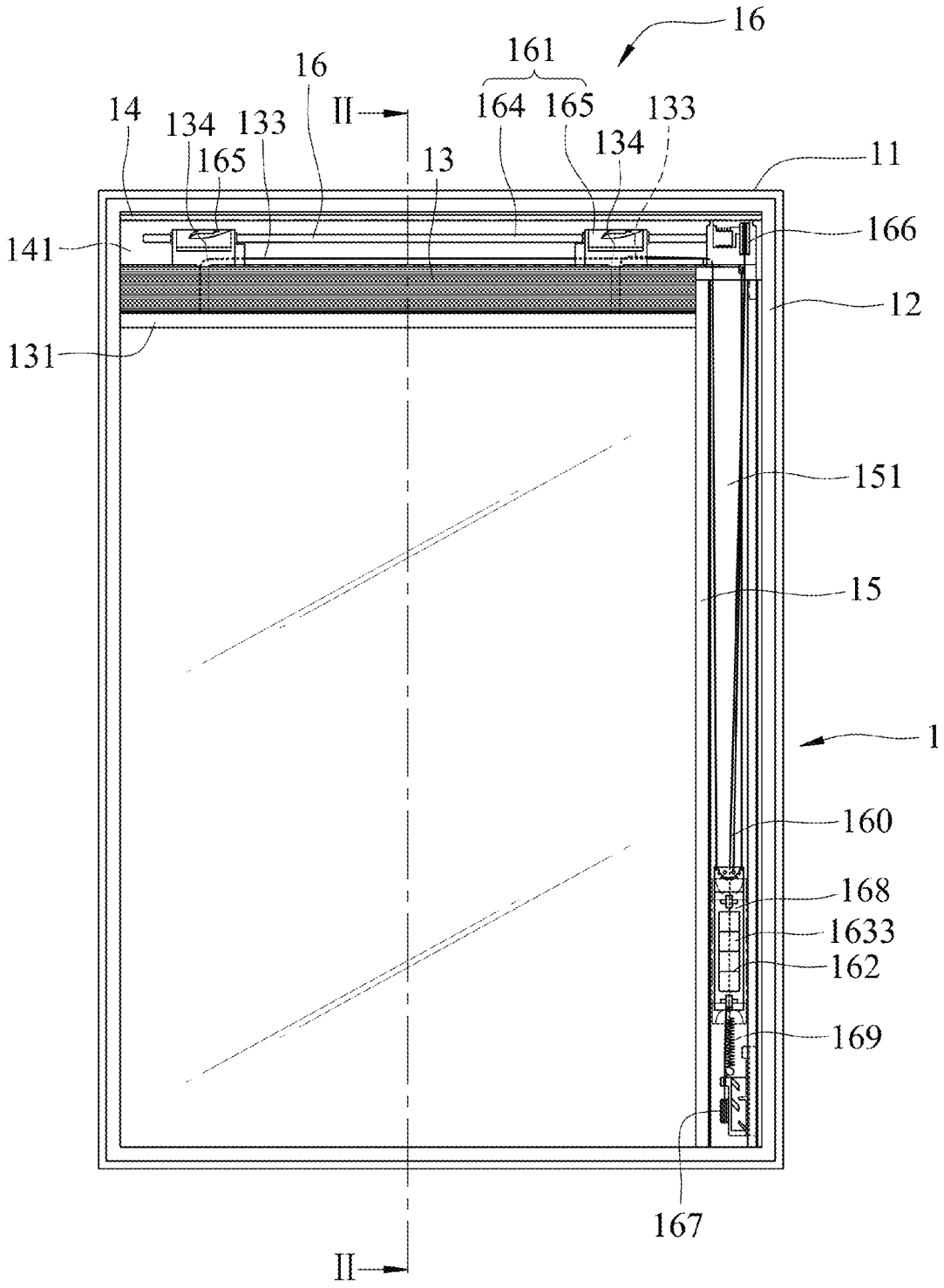
FIG.1 PRIOR ART
FIG. 1 is a schematic view of a conventional hollow built-in blind.
Figure 2:
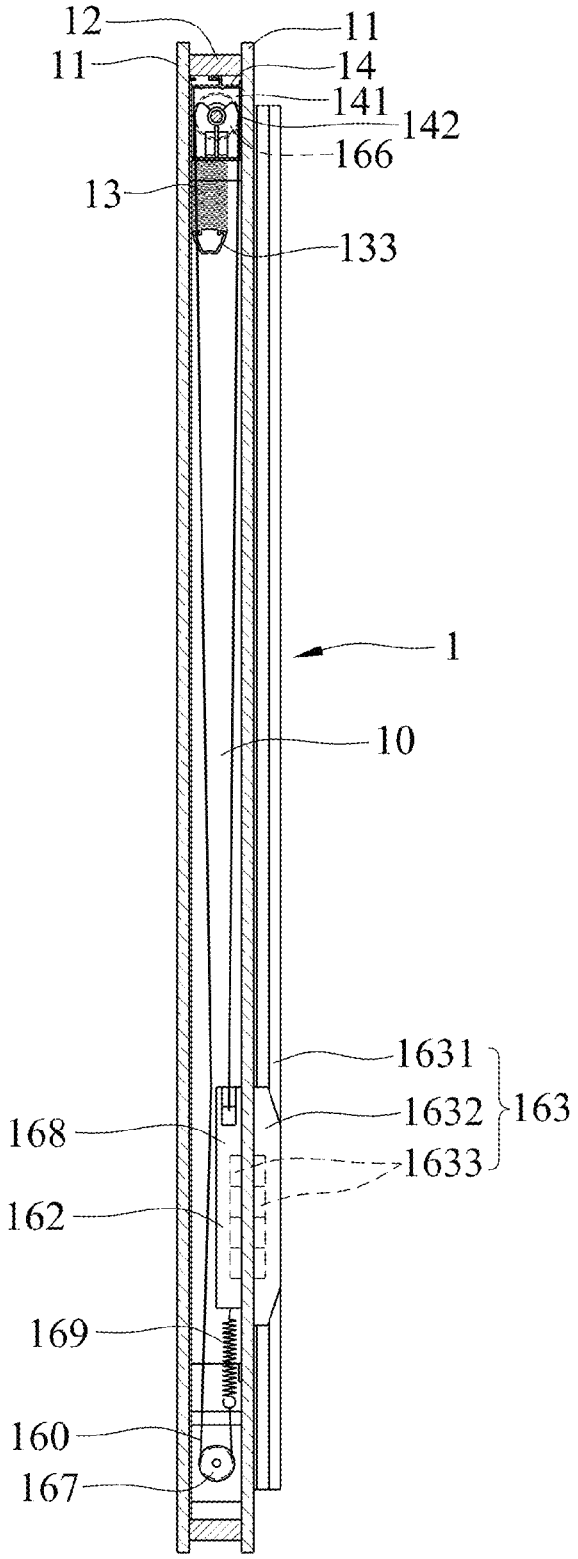
FIG.2 PRIOR ART
FIG. 2 is a sectional view of the conventional hollow built-in blind taken along line II-II of FIG. 1.
Figure 3:
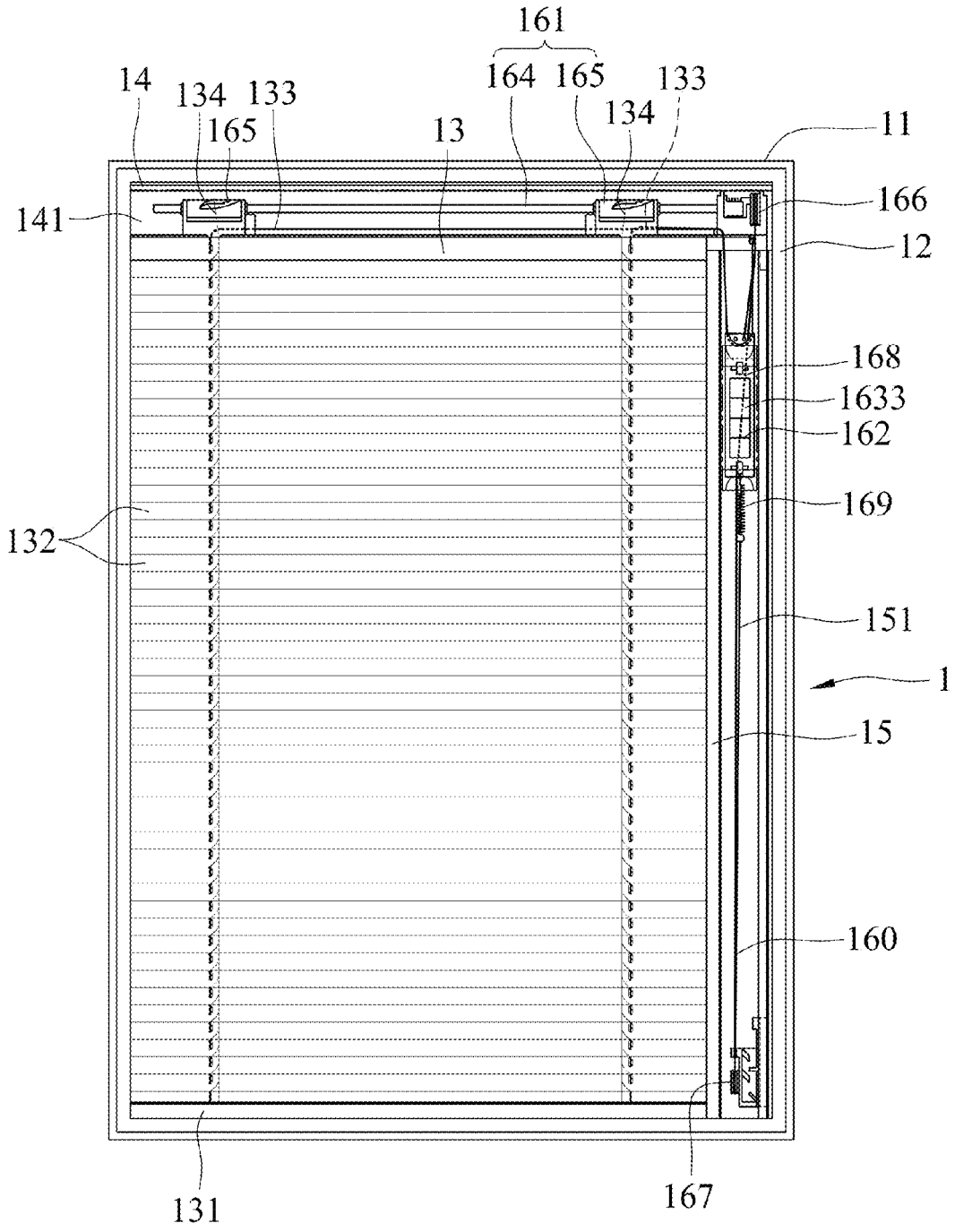
FIG.3 PRIOR ART
FIG. 3 is a view similar to FIG. 1, but with slats of a blind in a lowered position.

Referring to FIGS. 4 to 8, a hollow built-in blind according to the preferred embodiment of this invention comprises two glass plates 2, an annular spacer 3, a blind 4, an upper rail 5, a side frame 6, a transmission unit 7, a drive unit 8, and an external control device 9.

The annular spacer 3 is disposed between the glass plates 2, so that the glass plates 2 are spacedly parallel to each other. The spacer 3 and the glass plates 2 cooperatively define a receiving space 20.

The blind 4 is disposed in the receiving space 20, and includes a lower rail 41, a plurality of slats 42, two pull cords 43 each having one end connected to the lower rail 41 and the other end extending through the slats 42, and two cord ladders 44 respectively adjacent to the pull cords 43 for turning the slats 42.

The upper rail 5 is disposed in the receiving space 20 above the blind 4, and has a U-shaped groove 51 opening toward an inner surface of one of the glass plates 2, and a PVC cover plate 52 covering the U-shaped groove 51.

The side frame 6 is disposed in the receiving space 20 and is located at one lateral end of the blind 4. The side frame 6 has a U-shaped groove 61 opening toward the inner surface of the one of the glass plates 2, and a PVC cover plate (not shown) covering the U-shaped groove 61.

The transmission unit 7 is disposed in the U-shaped groove 51 of the upper rail 5, and includes a rotatable transmission shaft 71, a winding mechanism 72 disposed on the transmission shaft 71, and a belt pulley 73 fixed to one end of the transmission shaft 71. The winding mechanism 72 includes two cord-winding devices 721 spacedly disposed on the transmission shaft 71, and two cord ladder turning devices 722 disposed on the transmission shaft 71 and respectively connected to the cord-winding devices 721. The other ends of the pull cords 43 are respectively connected to the cord ladder turning devices 722 after extending through the slats 42.

Figure 5:
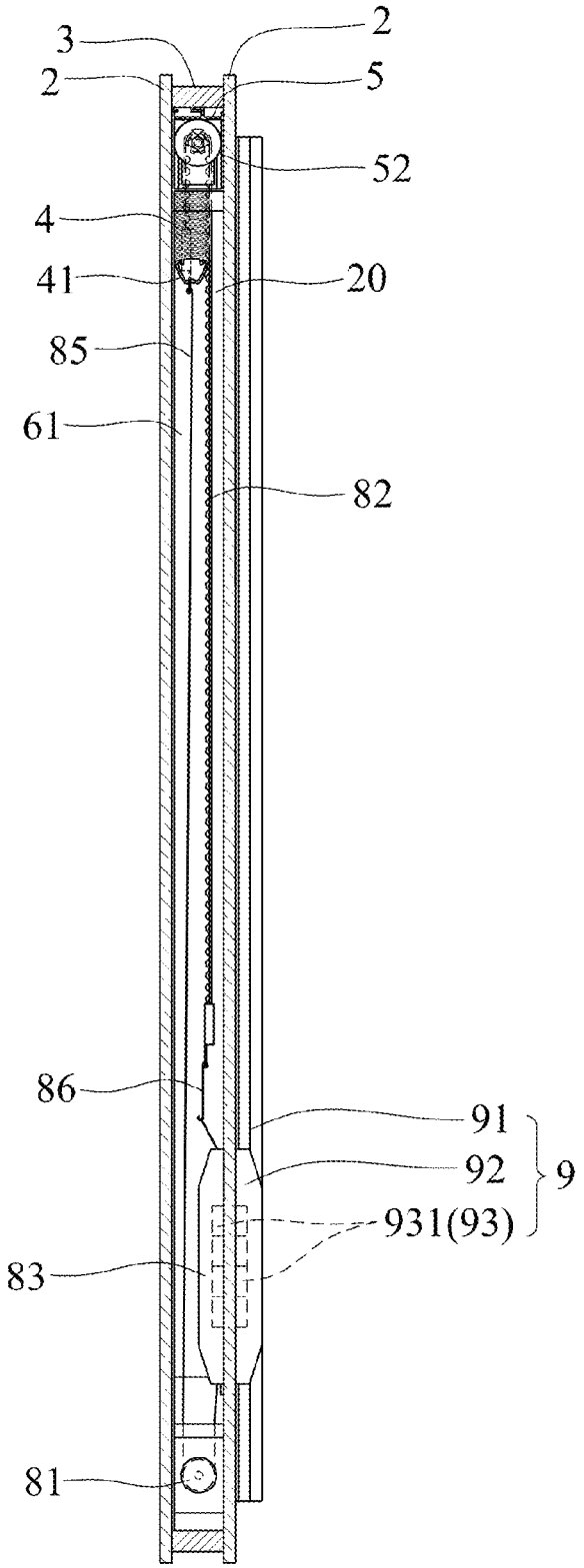
FIG. 5 is a sectional view of the preferred embodiment taken along line V-V of FIG. 4.
Figure 8:
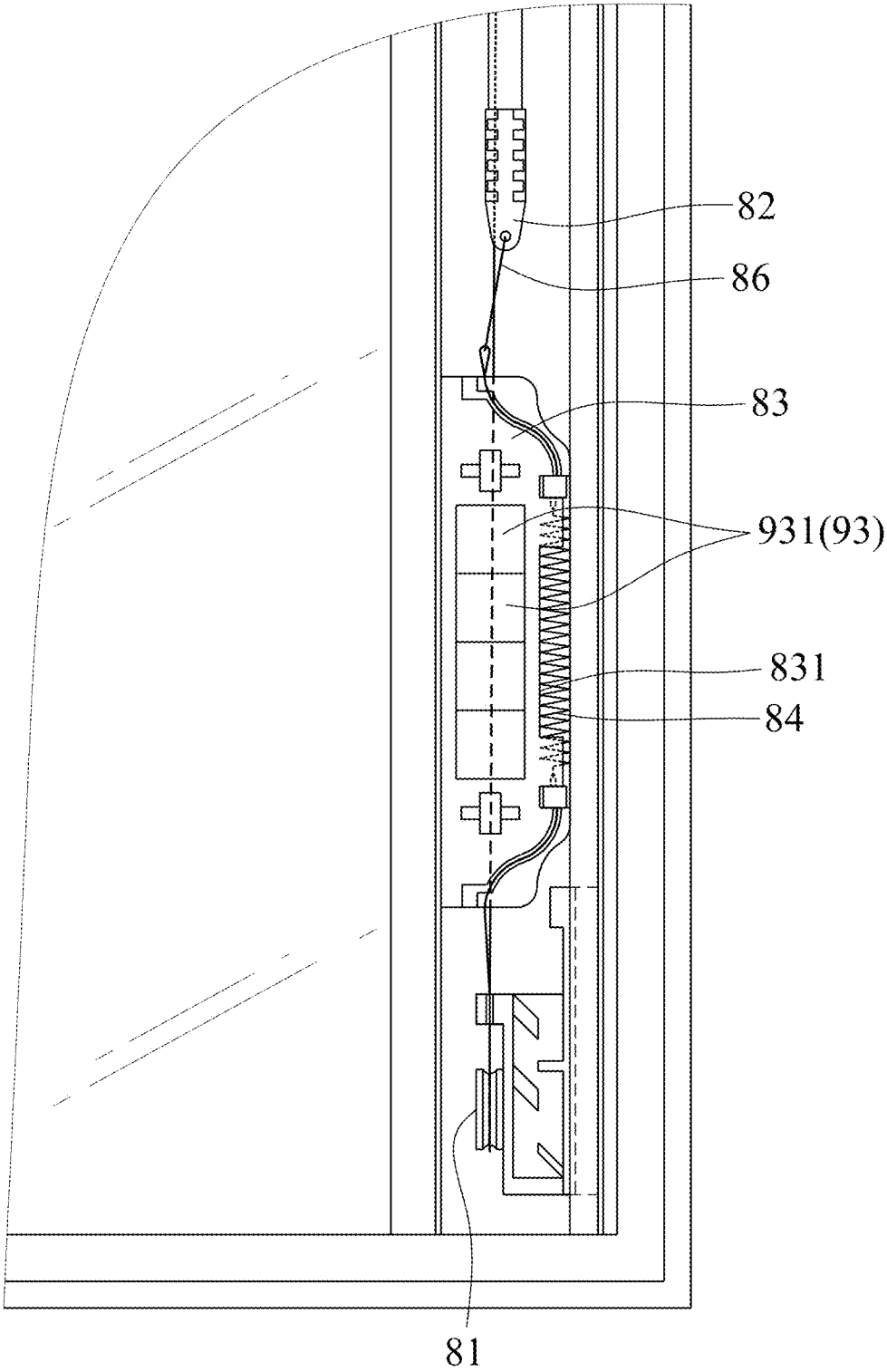
FIG. 8 is another fragmentary enlarged schematic view of the preferred embodiment, illustrating a connection relationship among an internal control device, the timing belt and a guide wheel.

The drive unit 8 is disposed in the U-shaped groove 61 of the side frame 6, and is located at one lateral end of the blind 4 that is proximate to the belt pulley 73. The drive unit 8 includes a guide wheel 81 connected to the side frame 6 and vertically spaced apart from the belt pulley 73, a timing belt 82, an internal control device 83, and a biasing member 84. The internal control device 83 is operable to move upward and downward in the U-shaped groove 61 of the side frame 6, and has a mounting portion 831 (see FIG. 8) to mount the biasing member 84. The timing belt 82 is looped over and meshes with the belt pulley 73, and has two opposite ends respectively connected to two opposite ends of the biasing member 84 by using two strings 85, 86 so as to form a closed loop. The string 85 connects one end of the timing belt 82 to one end of the biasing member 84 by looping over the guide wheel 81, as best shown in FIGS. 5 and 8. The string 86, which is shorter than the string 85, connects the other end of the timing belt 82 to the other end of the biasing member 84, as best shown in FIG. 8. The biasing member 84 generates a biasing force to move the two opposite ends of the timing belt 82 toward each other, so that the timing belt 82 can mesh against the belt pulley 73 and the tension of the timing belt 82 can be maintained. Thus, the timing belt 82 can accurately and smoothly drive rotation of the belt pulley 73. In this embodiment, the biasing member 84 is a tension spring.

The external control device 9 includes a guide rail 91 fixed to an outer surface of the one of the glass plates 11 and extending in a moving direction of the internal control device 83, an external controller 92 disposed slidably on the guide rail 91 and corresponding to the internal control device 83, and two magnet units 93 respectively embedded in the internal control device 83 and the external controller 92. The external controller 92 can drive the internal control device 83 through magnetic attraction between the magnet units 93. In this embodiment, each magnet unit 93 has a plurality of magnets 931.

Figure 4:
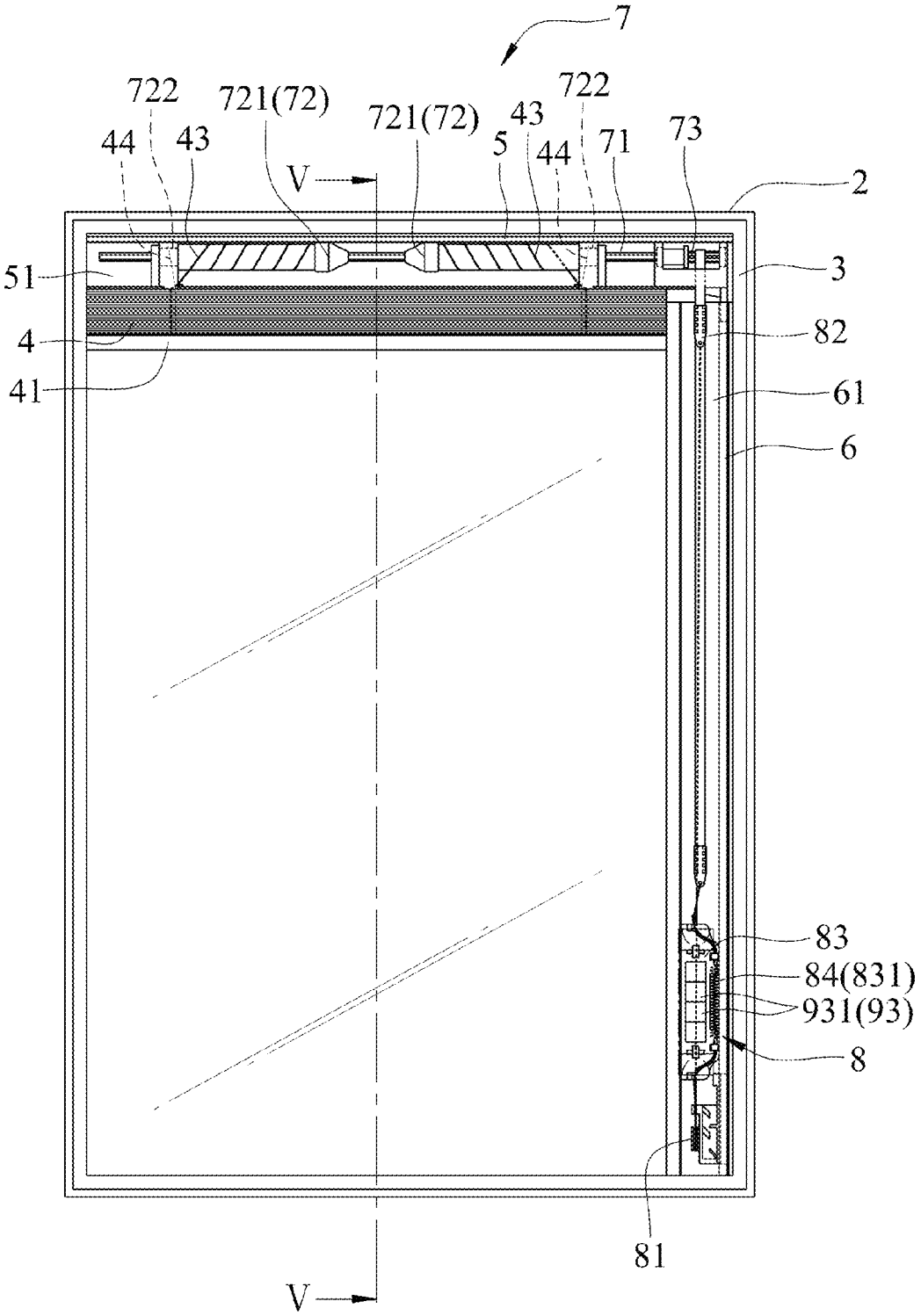
FIG. 4 is a schematic view of a hollow built-in blind according to the preferred embodiment of the present invention.
Figure 7:
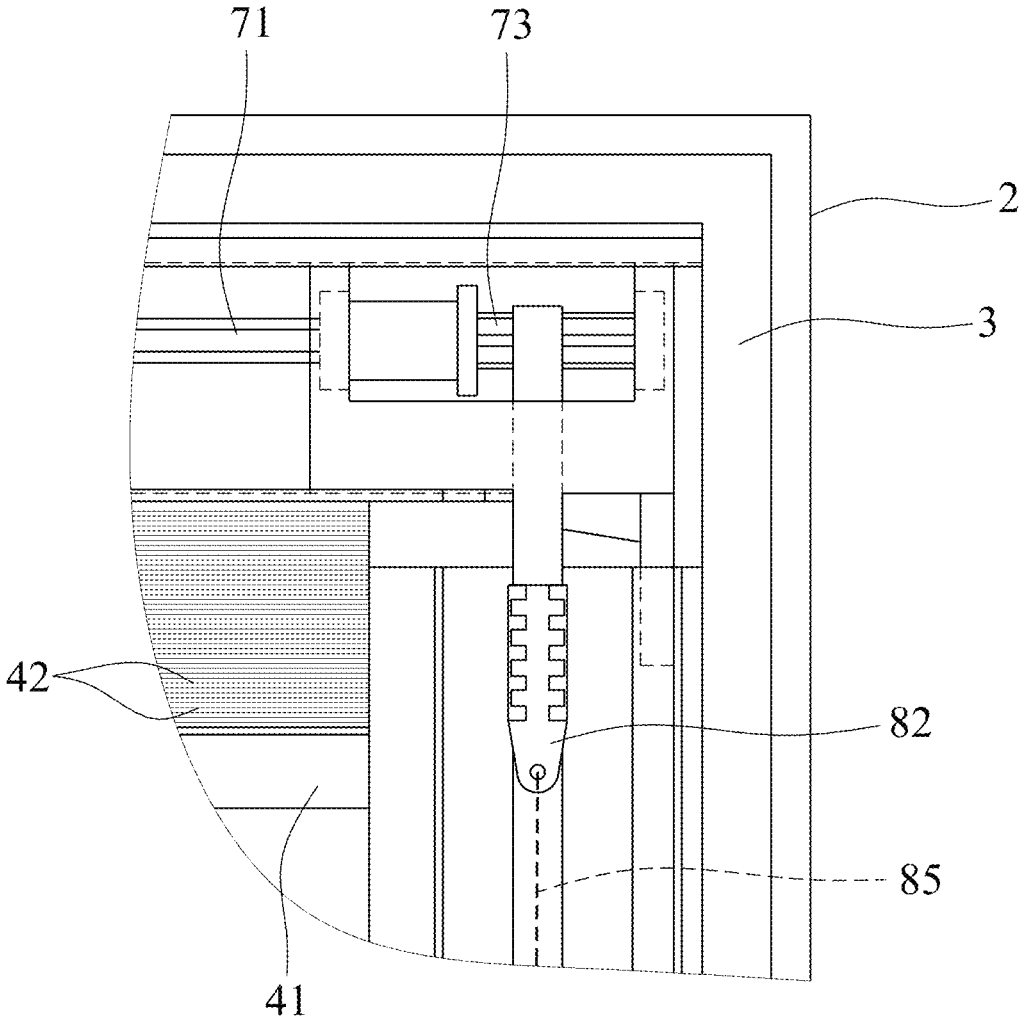
FIG. 7 is a fragmentary enlarged schematic view of the preferred embodiment, illustrating a connection relationship between a timing belt and a belt pulley.

With reference to FIGS. 4 and 7, when the external control device 9 drives the internal control device 83 to move downward, the internal control device 83 pulls the timing belt 82 so as to drive the belt pulley 73 to rotate the transmission shaft 71. Following the rotation of the transmission shaft 71, the cord-winding devices 721 respectively actuate the cord ladder turning devices 722 to drive the cord ladders 44 to turn the slats 42 such that the slats 42 are parallel to each other, and wind the pull cords 43 thereon. The pull cords 43, in turn, pull the lower rail 41 upwardly to raise the slats 42, so that the slats 42 are stacked one on top of the other and are supported by the lower rail 41.

Figure 6:
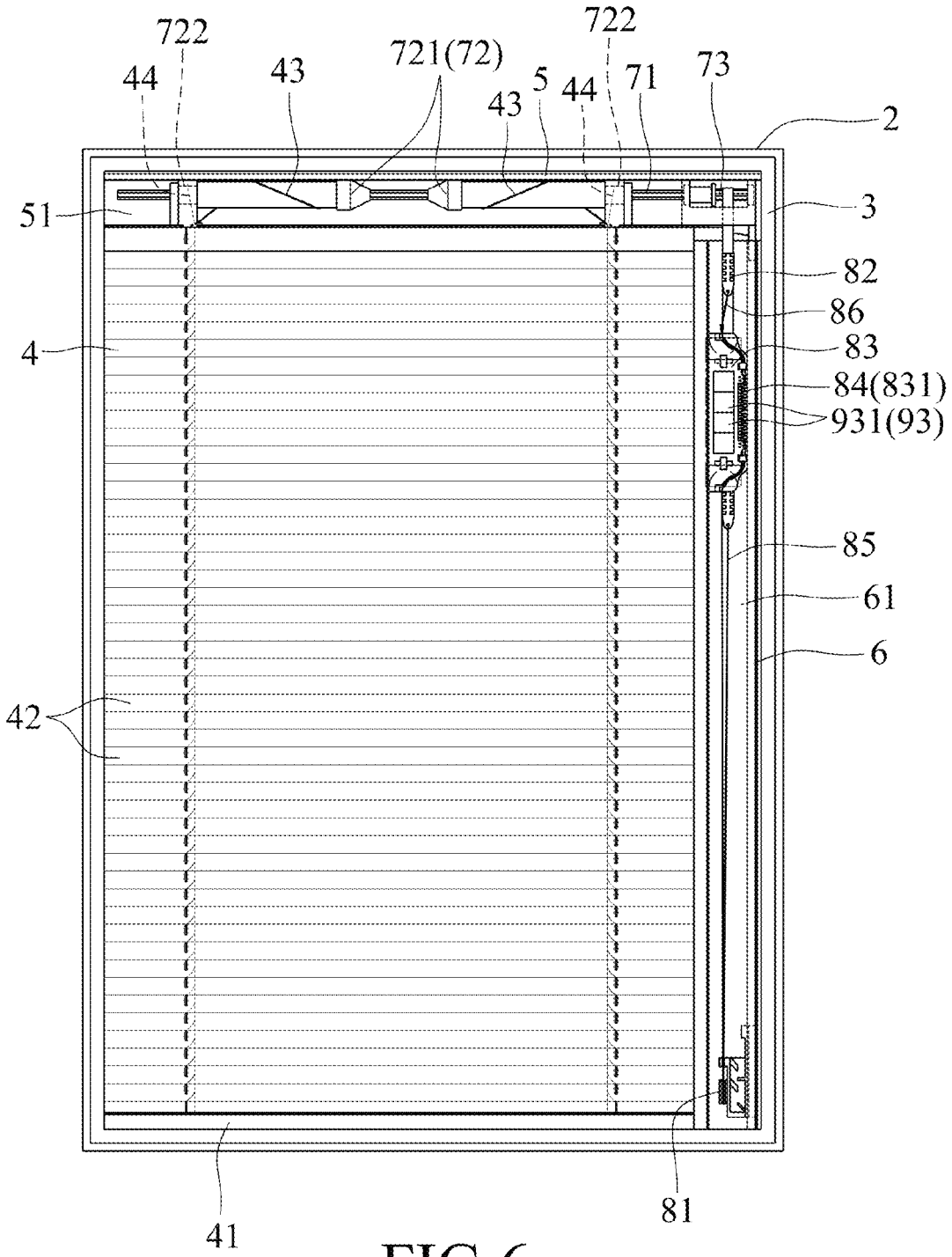
FIG. 6 is a view similar to FIG. 4, but with slats of a blind in a lowered position.

With reference to FIG. 6, when the external control device 9 drives the internal control device 83 to move upward, the internal control device 83 pulls the timing belt 82 so as to drive the belt pulley 73 to rotate the transmission shaft 71 in a reverse direction. Following the rotation of the transmission shaft 71, the cord-winding devices 721 respectively unwind the wound pull cords 43, and through the weight of the lower rail 41 that pulls down the pull cords 43, the slats 42 are sequentially lowered. Finally, the cord-winding devices 721 respectively actuate the cord ladder turning devices 722 to drive the cord ladders 44 to turn the slats 42 to a predetermined angle, so that the slats 42 cooperatively form a covering body.

In summary, because the timing belt 82 is meshed with the belt pulley 73, the internal control device 83 of the present invention can accurately actuate the belt pulley 73 to drive the transmission shaft 71 to rotate so as to wind and unwind the pull cords 43. Further, the transmission unit 7 of this invention not only has simple components, but also has high transmission accuracy and smoothness. Moreover, the pull cords 43 are directly wound on and unwound from the respective cord-winding devices 721, so that the slats 42 can be smoothly raised and lowered. Therefore, the object of the present invention can be realized.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A hollow built-in blind comprising:

two glass plates;

an annular spacer disposed between and cooperating with said glass plates to define a receiving space;

a blind disposed in said receiving space and including a lower rail, a plurality of slats, and two pull cords each having one end connected to said lower rail and the other end extending through said slats;

a transmission unit disposed in said receiving space above said blind and including a rotatable transmission shaft, a winding mechanism disposed on said transmission shaft, and a belt pulley fixed to one end of said transmission shaft, said other ends of said pull cords being connected to said winding mechanism after extending through said slats, said belt pulley being a gear wheel; and a drive unit disposed in said receiving space and located at one lateral end of said blind that is proximate to said belt pulley, said drive unit including a guide wheel spaced apart from said belt pulley, an internal control device operable to move upward and downward in said receiving space and having a mounting portion, a biasing member mounted on said mounting portion, and a timing belt looped over said belt pulley and said guide wheel, said timing belt meshing with said belt pulley and having two opposite ends respectively connected to two opposite ends of said biasing member to form a closed loop, said drive unit further including at least one string to connect one of said ends of said timing belt to a corresponding one of said ends of said biasing member, said biasing member generating a biasing force to move said two opposite ends of said timing belt toward each other;

wherein, when said internal control device is operated to move downward, said timing belt is pulled by said internal control device to drive rotation of said belt pulley which, in turn, drives rotation of said transmission shaft so as to wind said pull cords on said winding mechanism to thereby raise said slats; and wherein, when said internal control device is operated to move upward, said timing belt is pulled by said internal control device to drive reverse rotation of said belt pulley which, in turn, drives reverse rotation of said transmission shaft so as to unwind said pull cords from said winding mechanism to thereby lower said slats;

wherein, when said internal control device is in the downward position, said two opposite ends of said timing belt are spaced apart from each other with said one end of said timing belt being looped over and proximate to said belt pulley; and wherein, when said internal control device is in the upward position, said two opposite ends of said timing belt are proximate to each other.

2. The hollow built-in blind as claimed in claim 1, wherein said biasing member is a tension spring.

3. The hollow built-in blind as claimed in claim 1, wherein said winding mechanism includes two cord-winding devices spacedly disposed on said transmission shaft, said other ends of said pull cords being connected to said cord-winding devices after extending through said slats.

4. The hollow built-in blind as claimed in claim 1, wherein said blind further includes two cord ladders respectively adjacent to said pull cords, said winding mechanism further including two cord ladder turning devices disposed on said transmission shaft and respectively adjacent to said cord-winding devices, each of said cord ladders having one end attached to a respective one of said cord ladder turning devices, said cord ladder turning devices being actuated to drive said cord ladders to turn said slats.

5. The hollow built-in blind as claimed in claim 1, further comprising an external control device which includes a guide rail disposed on one of said glass plates, an external controller disposed slidably on said guide rail, and two magnet units respectively embedded in said internal control device and said external controller, said external controller being operable to move said internal control device through magnetic attraction between said magnet units.

* * * * *